US006170094B1

(12) United States Patent
Weise et al.

(10) Patent No.: US 6,170,094 B1
(45) Date of Patent: Jan. 9, 2001

(54) MODULAR WATERFALL APPARATUS AND METHOD

(75) Inventors: Gary K. Weise, Irvine; Richard J. Kesl, Yorba Linda; Fred C. Lesikar, La Habra, all of CA (US)

(73) Assignee: Thermocraft Ind. Inc., Orange, CA (US)

( * ) Notice: Under 35 U.S.C. 154(b), the term of this patent shall be extended for 0 days.

(21) Appl. No.: 09/003,854

(22) Filed: Jan. 7, 1998

(51) Int. Cl.[7] ..... B04H 4/00

(52) U.S. Cl. ..... 4/507; 4/678; 239/17; 239/590.3

(58) Field of Search ..... 4/507, 678; 239/17, 239/20, 193, 590.3, 597

(56) References Cited

U.S. PATENT DOCUMENTS 4,141,507 * 2/1979 Rump ..... 239/597 X
4,881,280 11/1989 Lesikar .
5,388,285 * 2/1995 Belniak ..... 4/507
5,609,305 * 3/1997 Webb ..... 239/590.3
5,738,280 * 4/1998 Ruthenberg ..... 239/17
5,893,179 * 4/1999 Johnson ..... 4/507

* cited by examiner

*Primary Examiner*—Robert M. Fetsuga
(74) *Attorney, Agent, or Firm*—Terry L. Miller

(57) ABSTRACT

An artificial waterfall apparatus and method for providing a sheet-like waterfall at the edge of a pool, spa, or fountain, for example, includes a first elongate chamber into which water flows perpendicularly to the length of this chamber, and in which a pair of oppositely directed like-rotating helical recirculation water flows are formed to sweep air and debris to opposite ends of the first chamber, while also contributing to uniformity of water distribution, pressure, and flow velocity in the apparatus. Air is discharged from the apparatus near one of the opposite sides of the waterfall so that the main central body of the waterfall is not disturbed by air bubbles. A second chamber receives water flow from the first chamber, and includes a flow distribution member which further contributes to uniformity of water flow in the apparatus. The apparatus has features which promote desirable structural strength in its use environment, and features which assist drainage of the apparatus for winter-time non-operation free of a damage risk from freezing.

27 Claims, 4 Drawing Sheets

Figure 5:
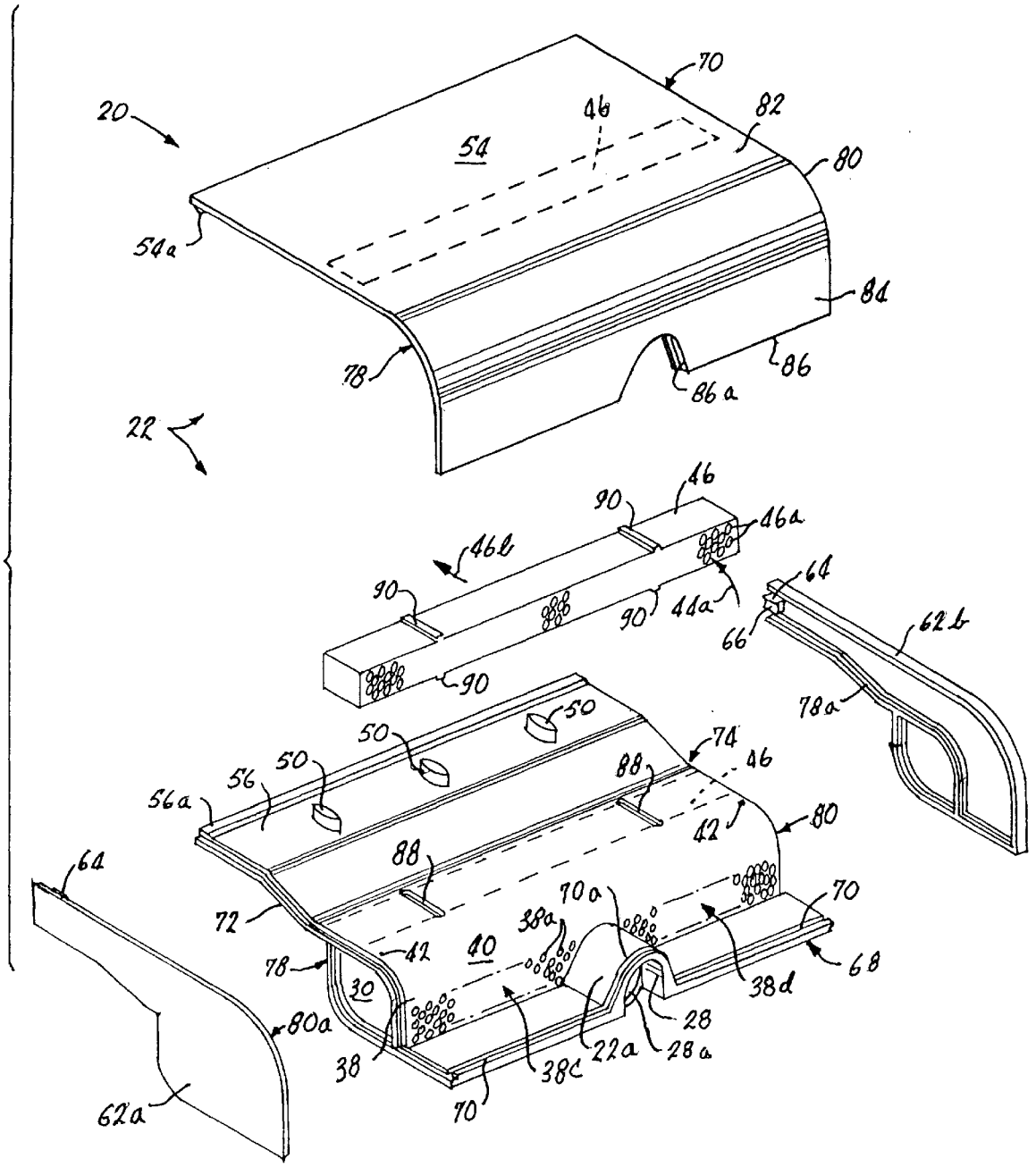

FIG. 1.
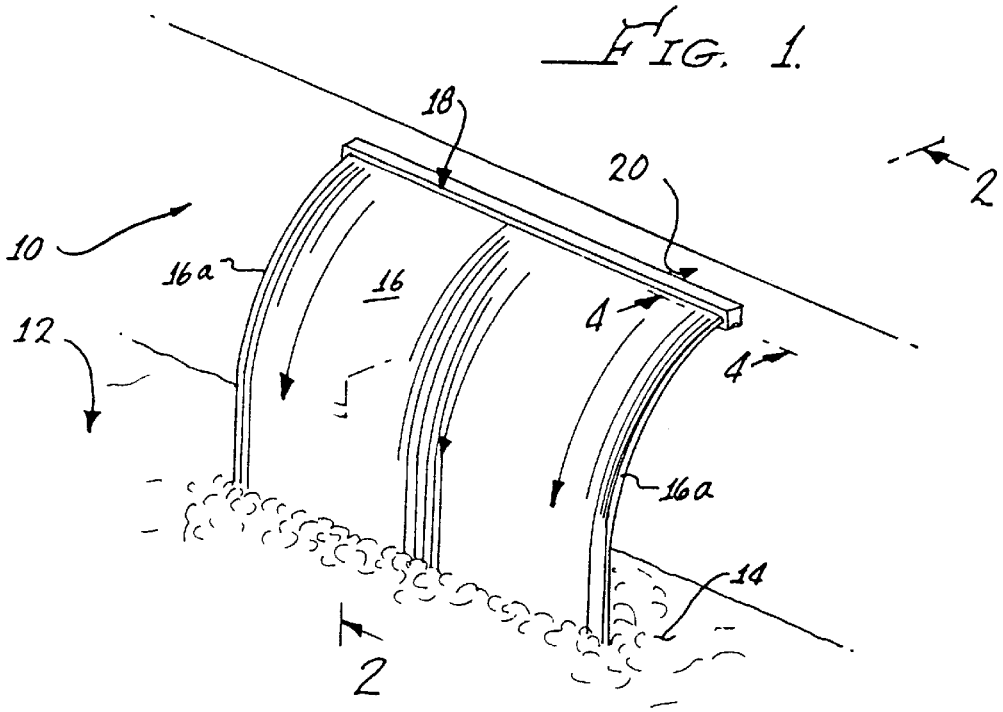
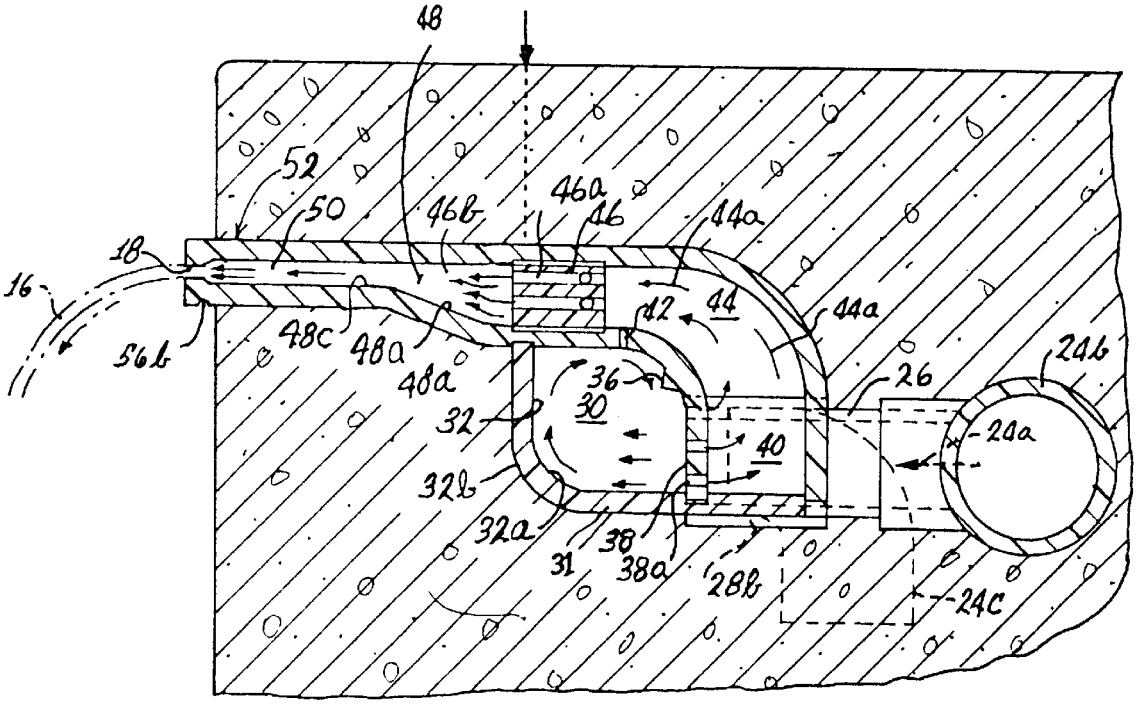
FIG. 2.

FIG. 2a.
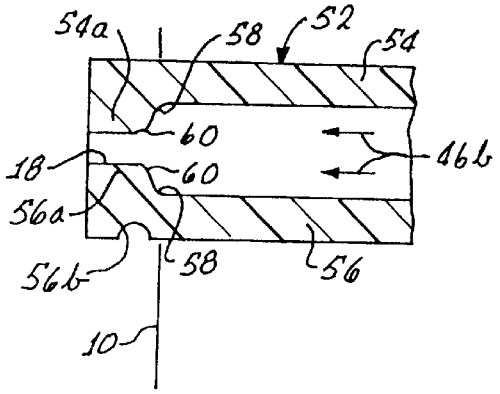
FIG. 3.
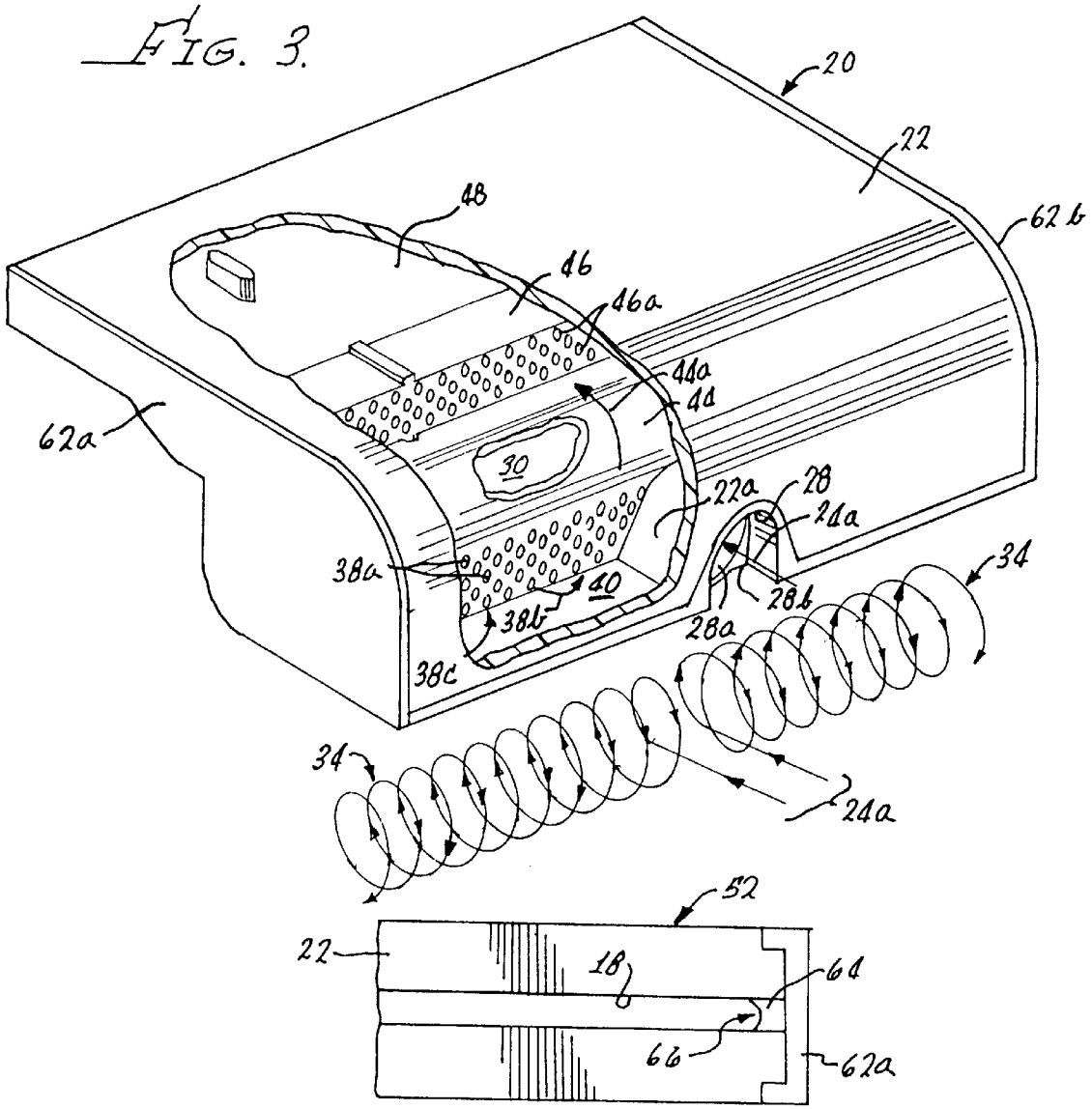
FIG. 4.

FIG. 6.
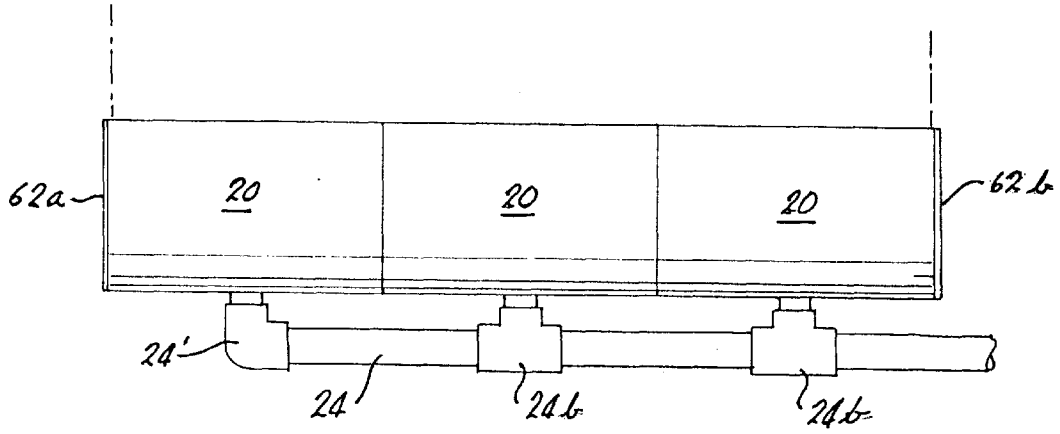
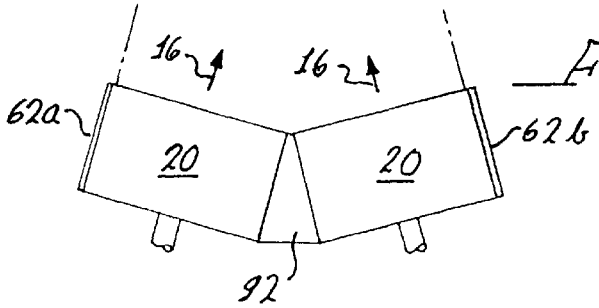
FIG. 7.
FIG. 7a.
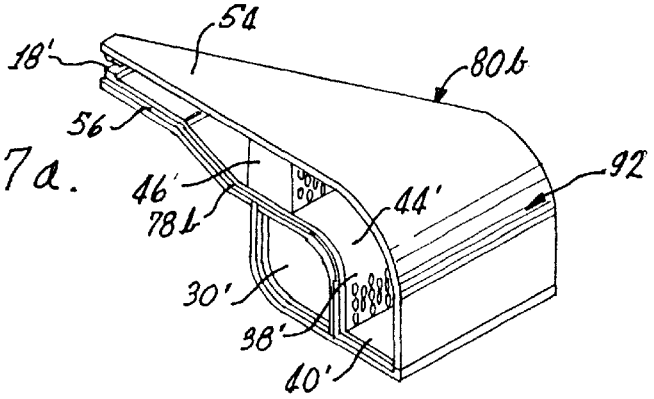
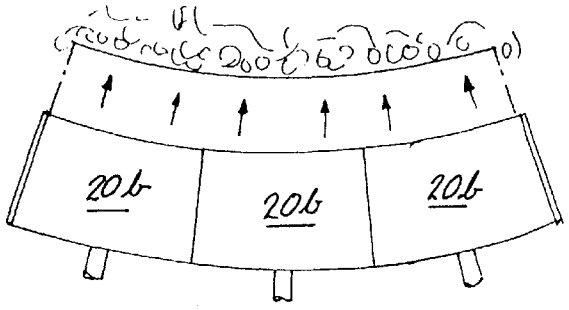
FIG. 8.

MODULAR WATERFALL APPARATUS AND METHOD

BACKGROUND OF THE INVENTION

1. Field of the Invention

The present invention is in the field of waterfall apparatus and methods. Such waterfalls are generally utilized to provide an aesthetically pleasing artificial waterfall at pools, spas, fountains, and other such man-made water facilities and displays. The invention more particularly relates to a modular waterfall apparatus which may be assembled from component parts in a wide variety of configurations and sizes, and which provides all of: a flexibility and ease of installation, an economy of materials utilization, installation labor and cost; and a quality of operation and waterfall appearance not heretofore available in this field.

2. Related Technology

A conventional artificial waterfall apparatus is known in accord with U.S. Pat. No. 4,881,280, issued Nov. 21, 1989 to Fred C. Lesikar. This waterfall apparatus according to the '280 patent is believed to be fabricated of sheet material, such as stainless steel sheet metal, and to be assembled using welding, brazing, or riveting, for example. The waterfall apparatus according to the '280 patent appears to utilize a rather large interior polonium chamber or a series of weirs, or both, in order to distribute and smooth the velocity of flow of water piped into the apparatus before this water is discharged via a nozzle apparatus. The nozzle apparatus of the '280 device appears to have a constant decrease of cross sectional flow area for the flow of water from the plenum chamber to a discharge slot from which the water issues generally horizontally as a wide, flat, and relatively thin sheet.

Conventional water fall apparatus, including the one taught by the '280 patent, are generally fabricated for each particular waterfall installation as a custom-made assembly, which is sized and configured to meet the demands and requirements of the particular swimming pool, spa, or fountain installation. Thus, the conventional waterfall apparatus generally are hand-made one at a time for particular uses, and are not modular, made of interchangeable parts, or economical in their fabrication costs. Additionally, when a waterfall of several feet in length is required, the problem of distribution of water within the waterfall apparatus becomes particularly challenging. Yet uniformity of water distribution, both in terms of the water pressure, velocity, and direction of flow must be accomplished if the waterfall is to have the pleasingly uniform sheet-like appearance that is desired.

Another problem with conventional waterfall apparatus of the type mentioned above is that debris (which may be introduced into the waterfall along with the water flow) can obstruct the device, and result in the disruption of the configuration of the falling water. Thus, it has become conventional to install an in-line strainer or filter upstream of these water fall devices. Of course, this in-line strainer or filter itself then becomes a maintenance item for the operator of the pool, spa, or fountain.

SUMMARY OF THE INVENTION

In view of the above, it would be desirable and is an object for this invention to provide a waterfall apparatus and method which avoids one or more of the deficiencies of the related art.

Further, it is an object for this invention to provide such a waterfall apparatus and method which is modular in form, and can be assembled from component parts to provide a wide variety of sizes and configurations of waterfalls.

Still further, it is an object for this invention to provide a waterfall apparatus and method which produces a sheet-like waterfall, which is substantially perfect so far as distribution, pressure, velocity, and direction of water flow making the sheet-like waterfall.

Accordingly, the present invention provides an apparatus for producing an artificial waterfall, the apparatus comprising: an elongate chambered body having a length and opposite ends and defining a water inlet port intermediate of its length, the body defining a water discharge nozzle slot extending along the length and from which water issues substantially horizontally as a generally horizontally-flowing sheet; the body internally defining a first elongate chamber extending along the length and into which the water inlet port opens intermediate of and generally perpendicularly to the length of the first chamber to create a pair of oppositely-extending recirculation-current water flows each extending helically from the inlet port toward a respective one of the opposite ends, and the body further having an elongate foraminous wall portion bounding the first chamber and through which water flows therefrom to a second chamber which also extends along the length, the second chamber communicating water flow to the water discharge nozzle slot.

An advantage of the present invention is the clarity and uniformity of the sheet-like waterfall which the apparatus and method produces. This uniform clear waterfall has a persistence and durability not found commonly in the related art, and will fall a greater distance without being broken up before it enters a pool of water, for example.

Another advantage of the present invention results from the modular nature of the apparatus, which may be assembled from a few interchangeable component parts into waterfall apparatus having a wide variety of sizes and configurations.

Yet another advantage results from the nature of incoming water flow to the waterfall apparatus, which incoming water flow is formed into a pair of like-rotating recirculating helical water flows, extending from a middle of a chamber in opposite directions to the ends of the chamber. These helical water flows sweep air and debris to opposite ends of the chamber. Debris of a sufficiently small size is discharged from the waterfall, while larger debris is deposited in a quiescent corner of the apparatus adjacent to the ends of the chamber, where is does not affect the discharging waterfall. Air is bled from the chamber and discharged from the waterfall apparatus near the edges of the sheet-like waterfall. Thus, this bled out air does not disrupt the central sheet-like waterfall.

Additional objects and advantages of this invention will be apparent from a reading of the following description of several particularly preferred embodiments of the present invention, taken in conjunction with the appended drawing Figures, in which like reference numerals are used throughout the several views to indicate like features, or features which are analogous in structure or function.

BRIEF DESCRIPTION OF THE DRAWING FIGURES

FIG. 1 provides a perspective view of a waterfall at the side of a pool or spa;

FIG. 2 is a fragmentary cross sectional view taken generally at plane 2—2 of FIG. 1, and showing a waterfall apparatus embodying the present invention;

FIG. 2*a* is a fragmentary cross sectional view showing a portion of the apparatus of FIG. 2 at an enlarged scale;

FIG. 3 provides a cut-away perspective view of the modular waterfall apparatus shown in the preceding drawing Figures;

FIG. 4 provides an enlarged fragmentary view of an portion of the apparatus indicated by arrows 4-4 seen in FIG. 1, and is taken looking in the direction opposite to water flow;

FIG. 5 is an exploded perspective view showing component parts of the modular water fall apparatus preparatory to assembly;

FIG. 6 provides a plan view of three interconnected modular water fall apparatus embodying the present invention for discharging a triple-wide waterfall;

FIG. 7 is a plan view of two interconnected waterfall modules embodying the present invention for discharging a double-wide and converging waterfall;

FIG. 7*a* is a perspective view of an interconnection portion of the waterfall apparatus seen in FIG. 7; and FIG. 8 provides a plan view of a triple-wide and arcuate-converging modular waterfall apparatus embodying the present invention, and which includes three arcuate water fall modules.

DETAILED DESCRIPTION OF AN EXEMPLARY PREFERRED EMBODIMENT OF THE INVENTION

Viewing FIGS. 1, 2, 2*a*, 3 and 4 in conjunction with one another, it is seen in FIG. 1 that at the side 10 of a swimming pool 12 having a water surface at 14, a water full 16 of wide sheet configuration discharges generally horizontally from an elongate nozzle slot 18. The nozzle slot 18 is located adjacent to and slightly below a deck surface 19. Also, the nozzle slot 18 is located some distance above the water surface 14 so the water fall 16 extends outwardly and curves pleasingly down to the water surface 16 in aesthetical and attractive form. It will be noted that the water fall 16 is substantially smooth both over its width and over its length of fall to the water surface 14. That is, the water fall 16 is free of bubbles, and ripples, and is free of openings or tears in the sheet-like form of this water fall. This water fall 16 is also free of edge-tears or disruptions of a smooth sheet-like form at its edges 16*a*. Thus, the water fall 16 provider a smooth solid sheet of flowing and falling water extending from the nozzle slot 18 to the water surface 14 which is decorative and pleasing both to the sight, and because of the sound that it produces.

Viewing now FIGS. 2–4, it is seen that the nozzle slot 18 is defined by a modular water fall apparatus 20 of unit width. For example, the apparatus 20 may be about one foot in width to provide a water fall 16 which is also about one foot wide. On the other hand, the apparatus 20 may be over a foot wide, if desired. Apparatus 20 includes a modular, multi-part and elongate housing 22, which will be further described below, and which will be seen to include several component parts which sealingly cooperate with one another. Most preferably, the component parts of the housing 22 will be understood to be sealingly and structurally secured to one another by the use of an adhesive, which is not shown in the drawing Figures. The housing 22 receiver pressurized water (as is indicated by the arrow 24*a* on FIG. 2) from a pipe line 24 having a T-fitting 24*b*. A pipe nipple 26 extends from the T-fitting 24*b* to be sealingly received into a socket 28 defined by the housing 22 about at its middle along the length of this housing. The socket 28 is preferably recessed at least partially into the rear of the housing 22, providing a notch 28*b* opening downwardly and allowing an elbow to be used if desired (rather than nipple 26) in order to provide water flow 24*a* into the waterfall apparatus while also allowing a reduced lay-length for the plumbing fittings. This use of an elbow 24*c* is illustrated in dashed lines in FIG. 2. Particularly, the use of a "street" elbow 24*c* allows the pipeline 24 to be below the water fall apparatus 20 while allowing a compact arrangement of the plumbing.

As is best seen in FIGS. 2 and 3 the housing 22 defines a first elongate chamber 30 into which the water flow 24*a* discharges. The chamber 30 extends from side to side of the housing 22, and the water flow 24*a* enters perpendicularly to the length of this chamber 30. The housing 22 includes a floor wall portion 31, and a wall portion 32 which confronts the water flow 24*a*. Wall portion 32 includes an upwardly curving transition section 32*a*, which causes the incoming water flow 24*a* to begin a circular recirculation flow, as is best seen in FIG. 2. As can be appreciated viewing FIGS. 2 and 3, the incoming water flow 24*a* fills the chamber 30, and in doing so separates to form two like-rotating helical recirculation water flows (each indicted with the numeral 34 on FIGS. 2 and 3).

As an aid to the reader, to visual this helical recirculation water flow, in FIG. 3 the arrows for water flow 34 are displaced from the chamber 30 and are displayed outside of the housing 22 so that the reader can better appreciate the nature and form of the water flow in chamber 30. This water flow in chamber 30 flows from the center of this chamber and extends from the center of chamber 30 to each opposite end of this chamber. In order to start, promote, and maintain this helical recirculation water flow 34 in chamber 30, the housing 22 includes an elongate re-entrant rib 36 extending from side to side of housing 22 within chamber 30. Further, the wall 32 includes plural externally exposed bonding ribs (only one of which is visible in FIG. 1) better providing for bonding of the pool plaster and/or concrete (i.e., shotcrete or gunnite, for example) to the body 22.

Below the rib 36, the housing 22 defines a perforate water-distribution wall portion 38 having an array of multiple apertures or holes 38*a*, by which water flows from the first chamber 30 outwardly and to a second chamber 40, as is indicated by arrows 38*b*. The water-distribution wall portion 38 is defined in two spaced-apart sections 38*c* and 38*d* (best seen in FIG. 5) of wall 38, one on each side of the wall portion 22*a* which forms socket 28. Further, because of the nature of the water flow 34 (i.e., helical recirculation flow from the center of chamber 30 toward each of the two opposite ends of this chamber), any debris which enters the chamber 30 along with the water 24*a* is swept to one of the opposite ends of this chamber, and is there deposited into a quiescent lower corner of the chamber 30. Importantly, the water distribution wall portion 38, along with the helical, oppositely-flowing nature of the water flow 34 in chamber 30, makes the use of an accessory or in-line filter unnecessary with the apparatus 20.

Further, when the water fall apparatus 20 is first put into operation, for example, the chamber 30 (or the pipeline 24 leading water flow to this chamber, or both), may contain a considerable amount of air, or air may be continually introduced into chamber 30 along with the water flow 24*a* (although this continual air introduction of air along with water 24*a* would indicate a less than optimum operation of the water circulating system of the pool 12). Air in chamber 30 (whether in this chamber at the outset of waterfall operation, or introduced along with the water flow 24*a*) is swept by the helical recirculation water flows 34 to one of the opposite ends of this chamber 30, and is purged from this chamber via one of a pair of upwardly extending bleed holes 42, only one of which is seen in FIG. 2. Because the bleed holes 42 are located adjacent to the opposite ends of the chamber 30 (i.e., opposite sides of the housing 22 and adjacent to an alignment with the opposite sides of water fall 16 with respect to water flow) the air purged from chamber 30 is discharged along with water fall 16 at one side or the other of this water fall near an edge 16*a*, and does not disrupt the main central sheet of this water fall. In this respect, it is an important feature of the wall portion 38 that the holes 38*a* are all disposed at a level lower than the top of the chamber 30, so that air is bled from this chamber primarily by the holes 42.

Returning to a consideration of the water flow from chamber 30 via apertures 38*a* and to chamber 40, it will be appreciated that because of the nature of water flow 34, and the perforate water distribution wall portion 38, the water entering chamber 40 is already well distributed from side to side of the apparatus 20. To further smooth and assure uniformity of this water distribution, both in terms pressure and velocity, the second chamber 40 defines a plenum chamber portion 44 which extends completely from side to side of housing 22*a*. Plenum chamber 44 conducts the water flow (indicated by arrows 44*a*) upwardly with a slight decrease in cross sectional flow area, and around a curve to a generally horizontal flow direction.

The water flow 44*a* then encounters and must flow through a perforate flow-smoothing and flow-unitizing wall part 46, which extends from side to side of housing 22, and which defines an array of through apertures or holes 46*a*. This wall part 46 represents a pressure-dropping flow resistance member in the path of the water flow 44*a*, and assures complete filing of plenum 44. The perforate wall member 46 also assures nearly perfect side to side water distribution in the apparatus 22 (i.e., for flow to the nozzle slot 18). Further, when the water (now represented by arrows 46*b*) exits the array of holes 46*a*, the velocity and pressure distribution across the width and the height of the housing 22 downstream of the wall member 46 is nearly constant. Importantly, the water flow down stream of flow-unitizing member 46 has substantially a single direction of flow, which is parallel and toward the nozzle slot 18.

Water flow 46*b* now enters a convergent-flow passage 48 which extends from side to side of housing 22 and to the nozzle slot 18. Passage 48 includes a first relatively short section 48*a* of constant cross sectional flow area, leading to a second converging section 48*b*. The section 48*b* leads to a section 48*c* which does not converge in height (viewing FIG. 2), but which does include plural vertically extending support struts 50. These support struts 50 extend across the passage 48 from top to bottom, and connect upper and lower walls of this passage, as will be further explained. Thus, there is some decrease of cross sectional flow area at the section 48*c*, although this area decrease is recovered down stream of the support struts 50. The struts 50 are streamlined as depicted in order to minimize the disturbance of the water flow 46*b* caused by these struts.

Section 48*c* of flow passage 48 leads to a convergent nozzle structure, generally indicated with the numeral 52, and which defines the nozzle slot 18. The nozzle structure 52 is more particularly seen in FIG. 2*a* and in FIG. 4. Viewing there Figures, it is seen that the housing 22 includes an upper wall member 54 and a lower wall member 56 which are spaced vertically apart. These upper and lower wall members 54, 56 are connected by struts 50. Thus, the struts 50 structurally connect the walls 54 and 56, and serve to stabilize the vertical size of the nozzle slot 18. Water flow 46*b*, once it has passed the support struts 50, approaches the nozzle slot 18, and encounters a respective pair of opposed and confronting lips 54*a* and 56*a* defined by these walls. The lips 54*a*, 56*a* each define a concave transition surface 58 leading to a convex transition surface 60. The surfaces 58 and 60 are spaced apart, oppose one another, and lead to the nozzle slot 18. Importantly, the surfaces 58, and 60 together provide for the convergence of the water flow 46*b* to the nozzle slot 18, and are both free of any step-changes in shape or contour. Thus, these lips 58 and 60 together provide for convergence of the water flow 46*b* to the nozzle slot 18 while avoiding the creation of any step-changes or cusps in the cross sectional flow area available to the water as it flows to and from the nozzle slot 18. Further, the wall 56 outwardly includes a reentrant groove 56*b* extending from side to side of the body 20 and inhibiting water flow (i.e., dripping) along the underside surface of wall 56 to the side wall 10 of pool 12 seen in FIG. 1.

Viewing also FIG. 4, it is seen that each end wall 62*a*/62*b* of the housing 22 (only one of which—wall 62*a*—is seen in FIG. 4) includes a projection 64. The projections 64 each define an accurate concave surface 66 bounding a respective end of the nozzle slot 18. Thus, the nozzle slot 18 (and water fall 16 at its origin as it issues from slot 18) has rounded opposite ends.

Considering now FIG. 5, it is seen that the housing 22 includes a lower component 68 which defines socket 28 and chamber 30 along with walls 32, 38 and 56. Component 68 also defines a groove 70 traversing the rear of housing 22 adjacent to chamber 40. This groove 70 at a section 70*a* extended over the wall portion 22*a*. At each opposite side edge 72/74, the component 58 defines an end opening 76 for this chamber 30, as well as a respective rabbet-and-rib configuration 78/80. The rabbet-and-rib configurations 78/80 are complementary to one another for an important purpose to be further explained. The rabbet-and-rib configuration 78 at side edge 72 has the rabbet spaced inwardly of the companion rib. Configuration 80 is opposite to configuration 78 with respect to the relation of the rabbet and rib. That is, at configuration 80, the rabbet is outwardly of its companion rib. In order to sealingly close the opposite ends of the waterfall apparatus seen in FIGS. 2 and 3, the opposite end wall members 62*a*/62*b* are provided with rabbet-and-rib configurations 78*a*/80*a*, as is shown in FIG. 5. Thus, these end wall members 62*a*/62*b* can engage with and be bonded adhesively to the remainder of housing 22, as is suggested in FIG. 5 by the arrows.

Still referring to FIG. 5, it is seen that upper wall member 54 has an upper wall portion 82 transitioning arcuately to a rear wall portion 84 Wall portion 84 defines a bottom edge 86 which has a V-shaped rounded notch 86*a*. Edge 86 and notch 86*a* are engageable with groove 70/70*a* of component 68.

The wall portion 82 also has corresponding rabbet-and-rib configurations 78/80 for cooperation with the end wall members 62*a*/*b*. Further to the above, the components 68/70 each define a pair of spaced apart recesses 88 (only two of which are seen in FIG. 5) for receiving respective ribs 90 defined on wall member 46. Thus, the wall member 46 is adhesively secured at a foot print (indicated with dashed lines in FIG. 5), and serves as an alignment member between the components 68/70. The foot print of wall member 46 is generally vertically above wall portion 32 (viewing FIG. 2, for example), so it can be seen that vertical loads applied from above on wall 54 (i.e., on component 70) are transferred through wall 46 to component 68, and hence to underlying structure.

It will further be noted that socket 28 has a lower extent at 28*a* (best seen in FIGS. 3 and 5), which is lower than the bottom wall of chamber 30. Thus, when the water fall apparatus 20 is not in operation (in winter, for example) and the pipe line 24 drains of water, then water will drain also from the apparatus 20 to the pipe line 24. It follows that very little water will remain in the apparatus 20, so that winter time freezing (for example) will not damage the apparatus 20.

Turning to FIG. 6, it is seen the plural modular apparatuses 20 are adhesively united to provide a water fall three units in width. In this case, the assembly of three modular apparatus 20 includes only two end wall members 62*a*/62*b*. The modular units 20 are complementary to one another, and are adhesively bonded together. In this case, it will be noted that some of the air bleed holes 42 will open intermediate of the width of the sheet configuration of falling water produced by this apparatus (i.e., rather than at the edges of the sheet only). However, purging of air from the apparatus 20 occurs mostly at the beginning of its operation, and any air bleed which occurs during operation of the device after this initial air purging is localized by the air bleed holes 42 so that the disruption of the water fall sheet (if any) takes place only at localized places. Also in this case, because the nozzle slot opening 18 is three units wide with only two end wall members 62*a* and 62*b*, the importance of the struts 50 in stabilizing the vertical dimension of the nozzle slot can be easily appreciated.

FIGS. 7 and 7*a* show a two-unit water fall apparatus in which the apparatus modules 20 are interfaced in fluid flow communication with one another via a wedge-shaped manifold member 92. This member 92 includes complementary rabbet-and-rib edge configuration 78*b*/80*b* corresponding to configurations 78/80 and complementary to one another. Corresponding features and structures of the manifold member 92 are indicated on FIG. 7*a* with the same numeral used above, and with a prince (') added. As is seen in FIG. 7, the modular water fall apparatus 20 are so oriented by member 92 that the water converges as it flows first horizontally and then transitions to vertical flow in its flow toward an underlying pool or spa. It will be understood that the member 92 could alternatively be wedge shaped to cause the modular units 20 to be angled apart in the direction of water flow, and so that the water flow itself would diverge in the waterfall.

Finally, FIG. 8 depicts a plural-module waterfall in which three modular units 20*b*, each of arcuate configuration are united to provide an arcuate waterfall of three units in width. Again in this case, the falling water converges toward a center of the arcuate shape of the three units 20*b* as it falls. It will be understood that the units 20*b* could alternatively be configures to be arcuate in a diverging direction so that the waterfall would diverge as it fell toward an underlying pool or spa.

It will be apparent in view of the above, that modular water falls of virtually unlimited size can be created by the combination of modules 20, 20*b*, manifold members 92, and pipe lines 24 as required. Thus, decorative and pleasing water falls can be economically provided by adhesively combine a limited number of easily fabricated components. A distinct advantage of the modular waterfall apparatus as depicted and described above, it that installers can field-fabricate a waterfall apparatus to meet particular installation requirements. Only adhesive bonding materials like those used with PVC pipe are required. The installer can make a waterfall apparatus to fit the installation situation, with no need for welding and without the time and expense involved in conventional metal, custom-fabricated waterfall units.

While the present invention has been depicted and is described by reference to a number of particularly preferred exemplary embodiments, this reference does not imply a limitation on the invention, and no such limitation is to be inferred. It will be apparent that a number of modifications can be made in the apparatus without departing from the spirit of the present invention. For example, the flow-unitizing member, which is depicted as a perforate wall 46, can be formed instead by an array of vertically extending fins, for example. These fins could be molded on one or both of the walls 54 and 56, and could intermesh if both walls are provided with fins. The fins could be straight, or could be chevroned to cooperatively provide a tortuous flow path for the water moving toward nozzle slot 18. Other modifications of the apparatus are possible, and will suggest themselves to those ordinarily skilled in the pertinent arts. These modifications are intended to fall within the scope of this invention. Thus, the invention is intended to be limited only by the spirit and scope of the appended claims, giving full cognizance to equivalents in all respects.

We claim:

1. An apparatus for producing an artificial waterfall, said apparatus comprising;

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber, and a wall portion disposed in confrontation to said water inlet port and being disposed generally perpendicular to and curving with respect to a perpendicular to the water flow entering via said water inlet port so as to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot.

2. The waterfall apparatus of claim 1 in which said water discharge nozzle slot defines a slot opening height dimension, and said elongate foraminous wall defines plural apertures opening between said first chamber and said second chamber, said plural apertures having a size which is smaller than said slot opening height dimension; whereby said foraminous wall acts to strain debris from said water, retaining particles of a size larger than said slot opening height dimension in said first chamber, and so that debris particles passing through said apertures of said foraminous wall are small enough to pass outwardly through said nozzle slot.

3. An apparatus for producing an artificial waterfall, said apparatus comprising:

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber, said body including a wall portion confronting said inlet port and extending perpendicularly to water flow inwardly from said water inlet port and said wall portion curving to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot;

wherein said housing further defines a pair of spaced apart air bleed apertures opening generally vertically from said first chamber to said second chamber, each one of said pair of air bleed apertures being disposed adjacent to a respective one of said opposite ends of said first chamber.

4. An apparatus for producing an artificial waterfall, said apparatus comprising:

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot; wherein said body further includes a wall portion bounding said first chamber and spaced from and confronting said water inlet port, said wall portion including a section which is perpendicular and curving relative to a direction of water discharge from said water inlet port into said first chamber so as to impel water entering said first chamber via said inlet port to begin recirculation current flow therein.

5. An apparatus for producing an artificial waterfall, said apparatus comprising:

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot;

wherein said body further includes a wall portion bounding said first chamber and spaced from and confronting said water inlet port, said wall portion including a section which is perpendicular to and curving relative to a direction of water discharge from said water inlet port into said first chamber so as to impel water entering said first chamber via said inlet portion to begin recirculation current flow therein;

wherein said body further includes an elongate rib member extending along said length of said first chamber adjacent to said foraminous wall portion, said rib turning said pair of recirculation water flows into said first chamber, whereby said pair of recirculation current water flows are caused to sweep across said apertures of said foraminous wall portion to clear debris particles therefrom.

6. The waterfall apparatus of claim 5 wherein said body further includes an elongate flow-unitizing member disposed in said second chamber intermediate of said foraminous wall portion and said discharge nozzle slot with respect to water flow therebetween, said flow-unitizing member extending between said opposite ends of said body and defining a respective plurality of apertures extending therethrough.

7. The waterfall apparatus of claim 6 in which said water discharge nozzle slot defines a slot opening area, and said respective plurality of apertures of said flow-unitizing member in combination define an area for water flow through said flow-unitizing member, said area of said plural apertures of said flow-unitizing member being from two to four times said nozzle slot opening area.

8. The waterfall apparatus of claim 5 in which said water discharge nozzle slot defines a slot opening area, and said plural apertures of said elongate foraminous wall in combination define an area for water flow from said first chamber to said second chamber, said combination area being from two to four times said nozzle slot opening area.

9. The waterfall apparatus of claim 6 in which said water discharge nozzle slot defines a slot opening area, said plural apertures of said elongate foraminous wall in combination define an area for water flow from said first chamber to said second chamber, and said respective plurality of apertures of said flow-unitizing member in combination also define an area for water flow through said flow-unitizing member, both said area of said plural apertures of said foraminous wall and said respective area of said plurality of apertures of said flow-unitizing member each being from two to four times said nozzle slot opening area.

10. The waterfall apparatus of claim 5 wherein said body further includes a horizontally spaced apart pair of walls extending between said opposite ends and bounding water flow in said second chamber, said pair of walls cooperating to define a cross sectional area for water flow which cross sectional area extends horizontally between said opposite ends and vertically between said pair of walls, at least one of said pair of walls being of a curvilinear shape along the direction of water flow in said second chamber to cooperatively bound with the other of said pair of walls a cross sectional area for water flow which varies non-linearly along said second chamber in the direction of water flow to said nozzle slot.

11. The waterfall apparatus of claim 10 wherein at least one of said pair of walls further defines a pair of oppositely directed curvilinear surface portions extending between said opposite ends and cooperating to effect a further reduction in said cross sectional area immediately preceding said nozzle slot.

12. The waterfall apparatus of claim 11 wherein said body further includes an end wall bounding an end of said nozzle slot, and said end wall including a portion defining a concave curvature for said end of said nozzle slot.

13. The waterfall apparatus of claim 12 wherein said end wall portion includes a projection extending into a space between said pair of walls, said projection having an arcuate surface bounding said nozzle slot.

14. The waterfall apparatus of claim 10 wherein said body further includes a plurality of vertically extending ribs extending between said pair of walls and in said second chamber.

15. The waterfall apparatus of claim 14 wherein said vertically extending ribs are streamlined in plan view and are arranged to generally be parallel with water flow to said nozzle slot.

16. An apparatus for producing an artificial waterfall, said apparatus comprising:

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber, said body including a wall portion confronting said water inlet port and said wall portion being disposed perpendicularly to and curving relative to a direction of water flow inwardly of said first chamber from said water inlet port to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot;

wherein said body includes a floor wall downwardly bounding said first chamber, said inlet port having a lower extent which is lower than said floor wall, whereby water will drain from said first chamber into said inlet port.

17. The waterfall apparatus of claim 5 wherein said body further includes a horizontally spaced apart pair of walls extending between said opposite ends and bounding water flow in said second chamber, an elongate flow-unitizing member disposed in said second chamber between and securing to said pair of walls intermediate of said foraminous wall portion and said discharge nozzle slot with respect to water flow therebetween, said flow-unitizing member extending between said opposite ends of said body and defining a respective plurality of apertures extending therethrough, said flow-unitizing member transferring weight applied to the upper one of said pair of walls to the lower one of this said pair of walls.

18. The waterfall apparatus of claim 17 wherein said body further includes said flow-unitizing member being in general vertical alignment with said wall portion, whereby vertically applied loads applied to the upper one of said pair of wall members is transferred via said flow-unitizing member to the lower of said pair of wall members and to said wall portion for support of said water fall apparatus.

19. An apparatus for producing an artificial waterfall, said apparatus comprising:

an elongate chambered body having a length and opposite ends and defining a water inlet port intermediate of its length, said body defining a water discharge nozzle slot extending along said length and from which water issues substantially horizontally as a generally horizontally-flowing sheet; said body internally defining a first elongate chamber extending along said length and into which said water inlet port opens intermediate of and generally perpendicularly to the length of said first chamber, said body having a wall portion confronting said water inlet port and being disposed perpendicularly to and curving relative to water flow into said first chamber from said water inlet port to create a pair of oppositely-extending recirculation-current water flows each extending substantially helically from said inlet port toward a respective one of said opposite ends, and said body further having an elongate foraminous wall portion bounding said first chamber and through which water flows therefrom to a second chamber which also extends along said length, said second chamber communicating water flow to said water discharge nozzle slot;

wherein said body further includes a horizontally spaced apart pair of walls extending between said opposite ends and bonding water flow in said second chamber, said pair of walls cooperating to define a cross sectional area for water flow which cross sectional area extends horizontally between said opposite ends and vertically between said pair of walls, at least one of said pair of walls being of a curvilinear shape along the direction of water flow in said second chamber to cooperatively bound with the other of said pair of walls a cross sectional area for water flow which varies non-linearly along said second chamber in the direction of water flow to said nozzle slot;

wherein said horizontally spaced apart pair of walls respectively upwardly and downwardly bound said nozzle slot, a lower one of said pair of walls outwardly defining an elongate reentrant groove, whereby said groove inhibits water flow past said groove from said nozzle slot along an underside of the outside surface of said lower wall.

20. An artificial waterfall apparatus, said apparatus comprising:

a chambered body defining a water inlet communicating water flow into a chamber of said body, and a horizontally elongate water discharge nozzle slot communicating water from said chamber outwardly of said body as a generally horizontally flowing sheet, said body including an upper wall and a separate lower wall cooperatively bounding said nozzle slot respectively in upward and downward directions, and a separate end wall portion bounding an end of said nozzle slot, and said end wall portion including a part extending between said upper and said lower wall and defining a concave curvature for said end of said nozzle slot.

21. A method for providing an artificial waterfall, said method comprising steps of:

providing an elongate chambered body having a length and opposite ends and defining a water inlet port intermediate of its length, defining with said body a water discharge nozzle slot extending along said length and from which water issues substantially horizontally as a generally horizontally-flowing sheet; defining with said body an internal first elongate chamber extending along said length and into which said water inlet port opens intermediate of and generally perpendicularly to the length of said first chamber, utilizing said water flow into said first chamber to form a pair of oppositely-extending recirculation-current water flows each extending helically from said inlet port toward a respective one of said opposite ends, utilizing said body to further define an elongate foraminous wall portion bounding said first chamber, and flowing water from said first chamber through said foraminous wall to a second chamber which also extends along said length, and utilizing said second chamber to communicate water flow to said water discharge nozzle slot.

22. The method of claim 21 further including the steps of utilizing said body to define for said nozzle slot a slot opening height dimension, and for said foraminous wall plural apertures opening between said first chamber and said second chamber, and selecting a size for said plural apertures which is smaller than said slot opening height dimension; and utilizing said foraminous wall to strain debris from said water.

23. A method for providing an artificial waterfall, said method comprising steps of:

providing an elongate chambered body having a length and opposite ends and defining a water inlet port intermediate of its length, defining with said body a water discharge nozzle slot extending along said length and from which water issues substantially horizontally as a generally horizontally-flowing sheet; defining with said body an internal first elongate chamber extending along said length and into which said water inlet port opens intermediate of and generally perpendicularly to the length of said first chamber, providing said body with a wall portion confronting said inlet port and being disposed perpendicularly to and curving relative to the inlet port, and utilizing said water flow into said first chamber curving along said wall portion to form a pair of oppositely-extending recirculation-current water flows each extending helically from said inlet port toward a respective one of said opposite ends, utilizing said body to further define an elongate foraminous wall portion bounding said first chamber, and flowing water from said first chamber through said foraminous wall to a second chamber which also extends along said length, and utilizing said second chamber to communicate water flow to said water discharge nozzle slot;

further including the step of utilizing a pair of spaced apart air bleed apertures opening generally vertically from said first chamber to said second chamber to bleed air from said first chamber toward a side edge of said horizontally-flowing sheet water fall.

24. The method of claim 23 further including the steps of including in said body a wall portion bounding said first chamber and spaced from and confronting said water inlet port, and including in said wall portion a section which is angled with respect to a direction of water discharge from said water inlet port into said first chamber and also with respect to a perpendicular to this direction so as to impel water entering said first chamber via said inlet port to begin said recirculation-current water flow therein.

25. The method of claim 23 further including the step of utilizing said body to define an elongate rib member extending along said length of said first chamber adjacent to said foraminous wall portion, and utilizing said rib to turn said recirculation water flow into said first chamber, and utilizing said turning of said recirculation water flow into said first chamber to cause a pair of helical recirculation current water flows to sweep in opposite directions towards the ends of said first chamber and across said apertures of said foraminous wall portion to clear debris particles therefrom.

26. The method of claim 23 further including the step of utilizing said body to define an elongate flow-unitizing member disposed in said second chamber intermediate of said foraminous wall portion and said discharge nozzle slot with respect to water flow therebetween.

27. The method of claim 26 further including the step of utilizing said plural apertures of said elongate foraminous wall to in combination define an area for water flow from said first chamber to said second chamber, utilizing said respective plurality of apertures of said flow-unitizing member in combination to also define a respective area for water flow through said flow-unitizing member, configuring both said area of said plural apertures of said foraminous wall and said respective area of said plurality of apertures of said flow-unitizing member to each be from about twice to about four time the area of said nozzle slot.

* * * * *